United States Patent [19]

Boenitz

[11] Patent Number: 4,668,931

[45] Date of Patent: May 26, 1987

[54] COMPOSITE SILICON STEEL-AMORPHOUS STEEL TRANSFORMER CORE

[75] Inventor: Maurice J. Boenitz, Lenox, Mass.

[73] Assignee: General Electric Company, King of Prussia, Pa.

[21] Appl. No.: 829,877

[22] Filed: Feb. 18, 1986

[51] Int. Cl.[4] ..... H01F 27/24

[52] U.S. Cl. ..... 336/212; 336/217; 336/234

[58] Field of Search ..... 336/212, 216, 217, 233, 336/234, 155; 310/216

[56] References Cited

U.S. PATENT DOCUMENTS

| | | | |
|---|---|---|---|
| 2,372,074 | 3/1945 | Ford | 336/212 X |
| 2,855,563 | 10/1958 | Williams | 336/155 X |
| 2,932,787 | 4/1960 | Krabbe et al. | 336/155 X |
| 4,364,020 | 12/1982 | Lin et al. | 336/212 |
| 4,506,248 | 3/1985 | Lin | 336/233 |
| 4,520,335 | 5/1985 | Rauch et al. | 336/212 |
| 4,520,556 | 6/1985 | Paske et al. | 29/606 |

*Primary Examiner*—Thomas J. Kozma

*Attorney, Agent, or Firm*—William Freedman; Henry J. Policinski

[57] ABSTRACT

A transformer core is disclosed having one or more winding legs built up from a plurality of silicon steel laminations and a pair of yokes built up from a plurality of amorphous steel laminations. The yokes and legs are serially joined by silicon steel-amorphous steel lamination joints to create a magnetic loop circuit and thus provide a transformer core having significantly improved core loss characteristics as compared to a power transformer core formed exclusively of silicon steel laminations.

10 Claims, 7 Drawing Figures

10
12
14
16
18
18a
18b
20
22
24
26
28
30
2
2

COMPOSITE SILICON STEEL-AMORPHOUS STEEL TRANSFORMER CORE

BACKGROUND OF THE INVENTION

The present invention relates to electrical transformers and particularly to a transformer core comprised of grain oriented silicon steel-amorphous steel composite.

Traditionally, electrical transformer cores have been formed of highly grain oriented silicon steel laminations. Over the years, significant improvements have been made in such electrical steel to permit reductions in transformer core size, manufacturing cost and the losses introduced into an electrical distribution system by the transformer core. As the cost of electrical energy continues to rise, reductions in core loss have become an increasingly important design consideration in all sizes of electrical transformers. For this reason, amorphous ferromagnetic materials are being actively considered for use in transformer cores to achieve a significant decrease in core operating losses.

Amorphous metals are principally characterized by a virtual absence of a periodic repeating structure on the atomic level, i.e., the crystal lattice, which is a hallmark of their crystalline metallic counterparts. The non-crystalline amorphous structure is produced by rapidly cooling a molten alloy of appropriate composition such as those described in Chen et al., in U.S. Pat. No. 3,856,513, herein incorporated by reference. Due to the rapid cooling rates, the alloy does not form in the crystalline state, but assumes a metastable, non-crystalline structure representative of the liquid phase from which it was formed. Due to the absence of crystalline atomic structure, amorphous alloys are frequently referred to as "glassy alloys".

Due to the nature of the manufacturing process, an amorphous ferromagnetic strip suitable for application in a laminated transformer core is extremely thin, normally 1–2 mils versus 7–12 mils for grain oriented silicon steel. Moreover, such amorphous steel strips are quite brittle and thus easily fractured. These characteristics render the processing of the amorphous strips into suitable core laminations and the subsequent handling thereof to build a transformer core a most difficult and rather costly procedure. That is, special cutting techniques are required to cut the amorphous steel strips to the desired core lamination sizes. Moreover, for stacked cores, such as utilized in power transformers, conventional lamination stacking, end lamination insertion, and clamping methods utilized in silicon steel laminated cores are not completely satisfactory for amorphous metal laminations because of the basic thinness, brittleness and strain sensitivity of this material. Another and perhaps most significant limitation of amorphous ferromagnetic steel is that it has an approximately 25% lower saturation density than grain oriented silicon steel. Consequently, an amorphous metal core would have to be physically larger than a silicon steel core in order to carry the same level of flux. This factor places a significant economic penalty in order to achieve reduced core losses particularly at higher KVA ratings, since amorphous steel constitutes a higher material cost than silicon steel. Yet another factor requiring a larger amorphous steel core relative to a comparably rated silicon steel core is that the former possesses an inherently lower packing factor, i.e., the ratio of ferromagnetic material cross sectional area in a core member to the overall cross sectional area of the core member.

The foregoing considerations have lead to the general consensus in the power transformer field that the numerous drawbacks of amorphous ferromagnetic steel cores economically outweigh the advantage of reduced core loss achieved therewith. There is however considerable activity with regard to the use of amorphous steel in physically smaller transformers typically applied to the distribution of electrical power as contrasted to the transmission of electrical power which is the realm of the power transformer. For example, U.S. Pat. Nos. 4,364,020 to Lin et al. and 4,520,335 to Rauch et al. disclose wound distribution transformer cores having a combination of amorphous steel and silicon steel laminations distributed throughout the yokes and legs which are joined together to provide one or more magnetic loop circuits consisting exclusively of amorphous steel and one or more magnetic loop circuits consisting exclusively of silicon steel. The same arrangement of parallel amorphous steel and silicon steel flux circuits is disclosed in a stacked core by Lin, U.S. Pat. No. 4,506,248.

It is accordingly an object of the present invention to provide a transformer core having improved core loss characteristics.

A further object of the present invention is to provide a transformer core of the above character which is constructed to utilize amorphous steel laminations in a commercially viable manner.

Another object of the present invention is to provide a transformer core of the above character which is formed of a combination of amorphous steel and silicon steel laminations to achieve a composite core having low loss characteristics.

An additional object of the present invention is to provide a amorphous steel-silicon steel composite laminated transformer core which is efficient in design, improved in manufacturability, and reliable over a long service life.

Other objects of the invention will in part be obvious and in part appear hereinafter.

SUMMARY OF THE INVENTION

In accordance with the present invention, there is provided a transformer core having at least its winding leg or legs built up from a plurality of silicon steel laminations and at least its yokes built up from a plurality of amorphous steel laminations. The yokes and legs are serially joined by silicon steel-amorphous steel lamination joints to create a magnetic loop circuit and thus provide a transformer core having significantly improved core loss characteristics as compared to a power transformer core formed exclusively of silicon steel laminations.

The invention accordingly comprises the features of construction, combinations of elements, and arrangements of parts which will be exemplified in the following detailed description, and the scope of the invention will be indicated in the claims.

DESCRIPTION OF THE DRAWINGS

For a fuller understanding of the nature and objects of the present, reference should be had to the following detailed description taken in conjunction with the accompanying drawings, in which.

Like reference numerals refer to corresponding parts throughout the several views of the drawings.

DETAILED DESCRIPTION

Figures 1, 2, 3:
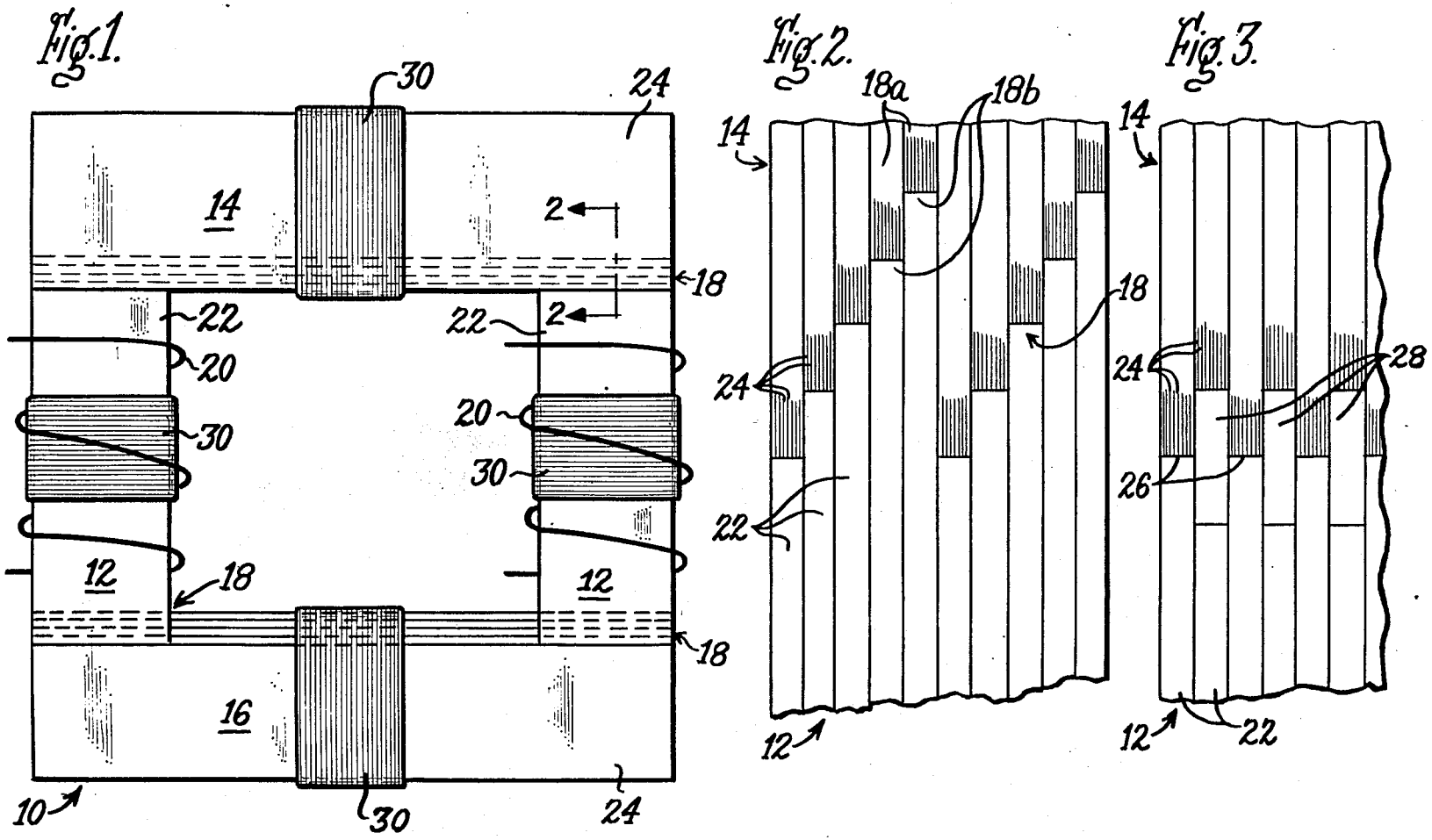
FIG. 1 is an elevational view of a stacked power transformer core constructed in accordance with one embodiment of the invention.
FIG. 2 is a fragmentary sectional view taken along line 2—2 of FIG. 1 to illustrate the joint construction utilized in the transformer core thereof.
FIG. 3 is a fragmentary sectional view of an alternative joint construction applicable to the transformer core of FIG. 1.

Referring to FIGS. 1 and 2, the present invention is shown embodied in a single phase, two legged power transformer core, generally indicated at 10, which is comprised of a pair of winding legs 12 interconnected in a magnetic loop circuit at their junctions with an upper yoke 14 and a lower yoke 16 by low reluctance stepped-lapped joints, generally indicated at 18 and best seen in FIG. 2. Wound about each leg are windings schematically indicated at 20. In accordance with a signal feature of the present invention, the winding legs are built up from a plurality of conventional grain oriented silicon steel laminations 22, while the yokes are built up from a plurality of amorphous steel laminations 24. These amorphous steel laminations may be of the type manufactured by Allied Corporation and marketed under the trademark METGLAS. Allied Corporation has also developed a so-called Power Core Strip which is particularly applicable to the present invention. This Power Core strip is comprised of six amorphous steel ribbons, each one mil thick, which have been compacted to a unitary strip or lamination five mils thick. Since amorphous steel ribbons are typically only 1–2 mils thick, each individual yoke stepped-lapped joint half 18*a* is comprised of a plurality of amorphous steel lamination 24 in order to properly mate with an individual leg stepped-lapped joint half 18*b* typically comprised of a single silicon steel lamination 22 (7–11 mils thick), as seen in FIG. 2.

FIG. 1 illustrates that the width of the yokes 14, 16 is significantly greater than the width of the legs 12, while their builds (thickness) are equal, as seen in FIG. 2. Consequently, the cross sectional area of the yokes is larger than that of the legs. This feature of the invention takes into account the lower magnetic saturation of amorphous steel as compared to silicon steel. Also factored into the appropriate relationship of the yoke cross sectional area to the leg cross-sectional area is the lower packing factor safely achievable with plural amorphous steel laminations. As is well understood in the art, the packing factor (also known as stacking factor) is the ratio of the cross-sectional area of the flux carrying ferromagnetic material in a core member to the overall cross sectional area of the core member. Thus, the packing factor takes into account the presence of voids between laminations caused by surface roughness, burrs, etc., and the insulation film on the lamination surfaces. The factors contributing to a lower packing factor for amorphous steel laminations are their far greater number required to achieve the desired build, thus proliferating the instances of interfacial voids and insulative film, and the intolerance from the standpoint of induced stress to any significant clamping pressures. Thus, an appropriate relationship of the cross sectional area of yokes 14, 16 to the cross sectional area of legs 12 is one that is inversely proportional to the ratios of the saturation inductance and packing factor of silicon steel to that of amorphous steel. For example, with a saturation inductance of 1.7 Tesla and a packing factor of 0.80 for amorphous steel laminations 24 relative to a saturation inductance of 1.98 Tesla and packing factor of 0.96 for silicon steel laminations 22, the ratio of yoke cross sectional area $A_y$ to leg cross sectional area $A_1$ can be calculated as:

$$A_y/A_1 = 1.98 \times 0.96/1.70 \times 0.80 = 1.40$$

This calculated area ratio may be optimized by taking into consideration the other specific magnetic properties of the two materials and their relative costs.

The basic reason the present invention is directed to the utilization of amorphous steel laminations in the yokes and silicon steel laminations in the winding legs is that the legs can then be of the smaller cross sectional area, and thus the savings in conductor length and consequent lower power loss in windings 20 can at least partically offset the increased material and manufacturing costs of utilizing amorphous steel laminations in yokes 14, 16. On this basis, the reduced core losses afforded by the utilization of amorphous steel in a power transformer core embodying the present invention becomes a commercially viable approach. Moreover, there are typically fewer dimensional restraints on the size of the yoke than on the size of the winding legs. Typically the yokes comprise about one-third of the core weight, and by utilizing amorphous steel therein having, for example, 20% of the losses associated with silicon steel, the total core loss of the composite amorphous steel-silicon steel core of the present invention is reduced by approximately 25% compared to a comparably rated full silicon steel core.

Joints 18 as seen in FIGS. 1 and 2 are effective in completing a low reluctance flux path between the larger cross section of the yokes and the smaller cross section of the winding legs. These joints are created by arranging silicon steel leg laminations 22 of equal length in sets, with the mid-length points of the laminations in each set uniformly offset in their lengthwise direction to achieve at each leg end the repeating step pattern of leg joint halves 18*b* seen in FIG. 2. To create the mating step pattern of yoke joint halves 18*a*, amorphous steel laminations 24 of equal length are arranged in groups terminating in joint halves 18*a*. The groups are arranged in sets with the laminations in the respective groups therein being of incrementally different widths. The lateral edge of the laminations 24 along the outer sides of the yokes are aligned, thus to achieve the repeating sets of yoke joint halves 18*a* along the inner sides of the yokes 14, 16 seen in FIG. 2. It will be appreciated that the yoke laminations may be of uniform width with their longitudinal centerlines laterally offset to create joint halves 18*a*. The resulting misalignment of the outer edges of the yoke laminations may be remedied with ferromagnetic inserts, if desired.

FIG. 3 is sectional view of an alternative joint construction which is based on the teachings of commonly assigned U.S. Pat. No. 4,520,556, the disclosure of which is incorporated herein by reference. This patent is directed to an improved stacked power transformer core assembly process predicated on the utilization of ferromagnetic inserts to perfect the corner joints between the top yoke and the winding legs. This allows the brittle amorphous steel laminations 24 to be carefully stacked up individually or in groups on a horizontal surface in a preassembly area to the build of yokes 14 and 16. The silicon steel laminations 22 can then be cut and stacked with great precision to achieve a perfect match between the legs and the bottom yoke 16 utilizing the stepped-lapped joints 18 illustrated in FIG. 2 and between the legs and the upper yoke 14 utilizing the joint pattern illustrated in FIG. 3. As seen therein, every other silicon steel leg lamination 22 is butted with the aligned group of amorphous steel top yoke laminations 24, as indicated at 26. The intervening leg laminations and aligned groups of top yoke laminations are sized such as to terminate short of each other, leaving spaces in which are accommodate inserts 28 of ferromagnetic material, preferably silicon steel. It is seen that inserts 28 provide stepped-lapped joints between the silicon steel leg laminations 22 and the amorphous steel top yoke laminations 24. The laminations of the legs and yokes are then clamped together by suitable means such as epoxy resin impregnated glass tape wrappings 30 seen in FIG. 1. All of these assembly steps are performed while the core is lying in a horizontal plane. The inserts 28 are then pulled, and top yoke 14 is carefully moved away. The core sans the top yoke is uprighted to facilitate assembly of windings 20 onto legs 12. The top yoke is carefully hoisted into place atop the legs, and inserts 28 are reinserted to perfect low reluctance joints therebetween. It is seen that this manufacturing procedure minimizes the handling of individual amorphous steel laminations and thus reduces the potential for damage thereto, thereby rendering the composite amorphous steel-silicon steel transformer core of the present invention viable from a manufacturing cost standpoint.

Figure 5:
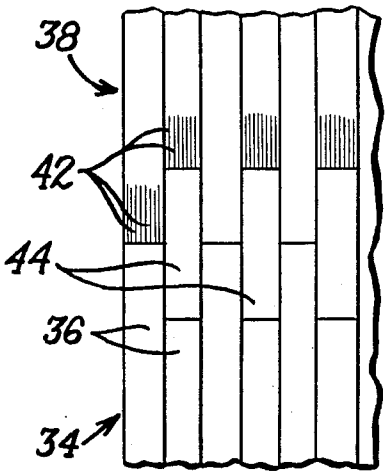
FIG. 5 is a fragmentary sectional view taken along line 5—5 of FIG. 4 to illustrate the joint construction utilized in the transformer core thereof.
Figure 4:
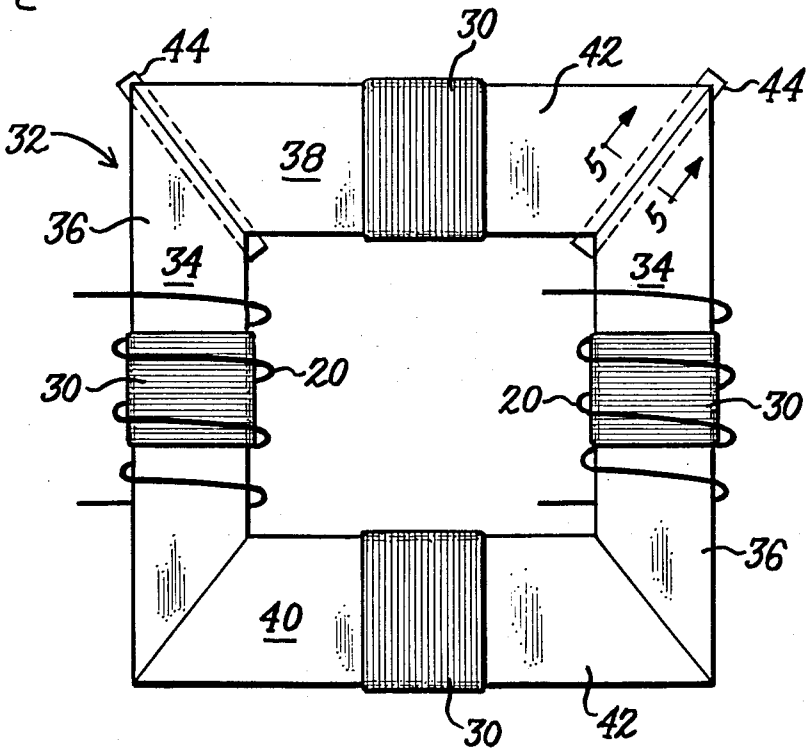
FIG. 4 is an elevational view of stacked transformer core constructed in accordance with an alternative embodiment of the invention.

FIGS. 4 and 5 illustrate a single phase core 32 having a pair of legs 34 built up from a plurality of silicon steel laminations 36 and upper and lower yokes 38 and 40, respectively, built up to a larger cross section with a plurality of amorphous steel laminations 42. These yoke and leg laminations are banded together, as indicated at 30. The ends of these laminations are cut on a diagonal to provide for mitered leg-yoke joints. At least those of the joints envolving the upper yoke 38 include silicon steel inserts 44 in the manner shown in FIG. 3 and as taught in the above-noted U.S. Pat. No. 4,520,556. This patent also teaches how a three-legged amorphous steel-silicon steel composite core would be constructed to utilize the manufacturing advantages afforded by the incorporation of ferromagnetic inserts in the upper yoke-winding leg mitered joints.

Figure 7:
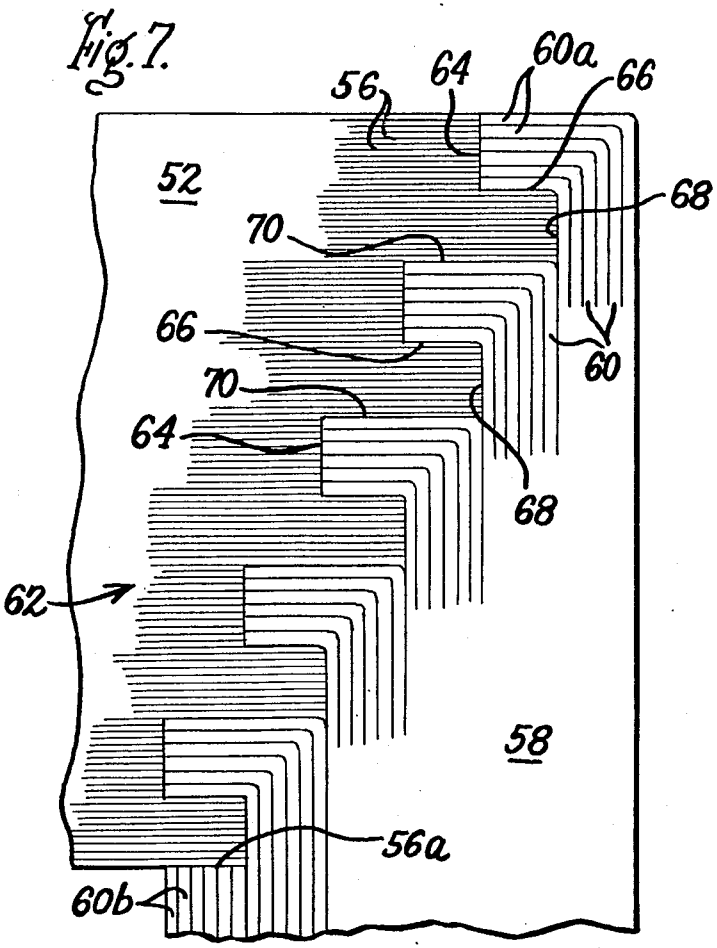
FIG. 7 is an enlarged fragmentary view of the upper right corner joint region of the transformer core of FIG. 6.
Figure 6:
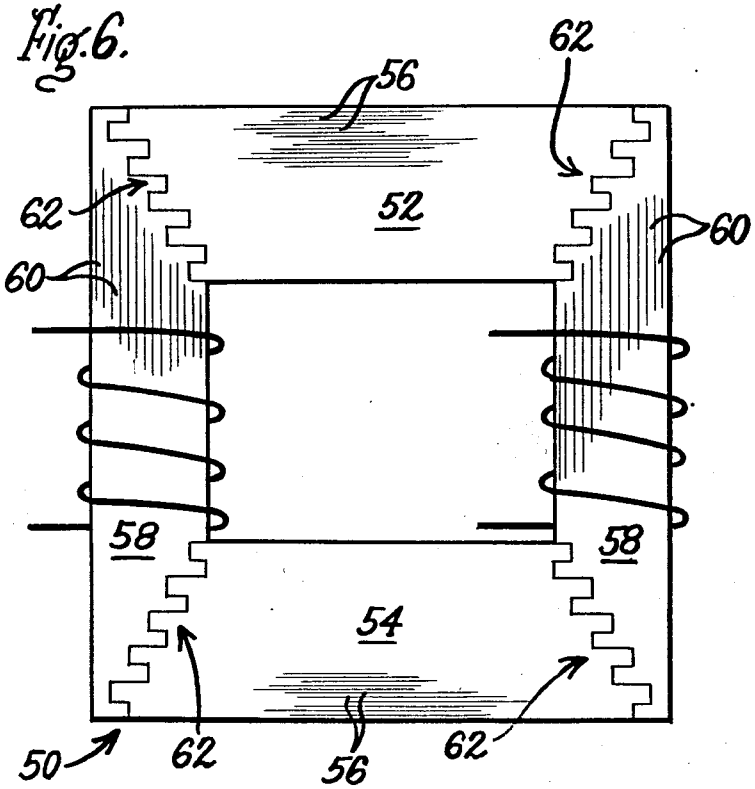
FIG. 6 is an elevational view of a transformer core constructed in accordance with yet another embodiment of the invention.

FIGS. 6 and 7 illustrate a transformer core 50 having an upper yoke 52 and a lower yoke 54, each comprised of amorphous steel laminations 56, and a pair of winding legs 58 comprised of silicon steel laminations 60. In contrast to the stacked cores of FIGS. 1 and 4, the laminations of core 50 have their lateral edges exposed at the core faces. Thus, the construction of this core is analogous to a wound core common in distribution transformer designs. Again the cross sectional area of the amorphous steel yokes is appropriately larger than that of the silicon steel legs. Core 50 utilizes a unique low reluctance joint generally indicated at 62, to effect the transistions from the silicon steel legs of a lesser cross sectional area to the amorphous steel yokes of a greater cross sectional area. As best seen in FIG. 7, the terminal portion at each end of the silicon steel laminations 60 is offset at a right angle to the plane of the lamination, as indicated at **60*a*. Starting from the outer corner, a first group of these somewhat U-shaped silicon steel leg laminations are seen to be nested together such that their straight cut ends butt with a first group of amorphous steel yoke laminations 56, as indicated at 64, and lap with an immediately adjacent second group of amorphous steel yoke laminations, as indicated at 66. In addition, the cut ends of this second group of amorphous steel yoke laminations butt with the innermost one of the nested first group of U-shaped silicon steel leg laminations, as indicated at 68, while the end portions thereof lap the 90° offset end portions 60*a* of a second group of silicon steel laminations at 70. This joint pattern is repeated with succeeding groups of pregressively shorter silicon steel leg laminations which butt and lap with succeeding groups of progressively shorter amorphous steel yoke laminations. It may be necessary in order to achieve a desired yoke-leg cross sectional area relationship to add an innermost group of straight silicon steel leg laminations, as indicated at 60*b*, whose cut ends are lapped by the innermost group of amorphous steel yoke laminations, as indicated at 56*a***.

While the transformer cores have been disclosed herein as having yokes built up exclusively of amorphous steel laminations, it may be desirable to incorporate several silicon steel laminations strategically located to afford support and protection for the fragile amorphous steel laminations. That is, for example, the yokes of the cores in FIGS. 1 and 4 may be faced front and back with silicon steel laminations, while the innermost and outermost yoke laminations in the core of FIG. 6 may be silicon steel laminations.

It will be appreciated that the present invention is equally applicable to power transformer cores having only a single winding leg, such as is the case in shell-type transformer cores. The non-winding leg or legs of these cores are considered as extensions of the yokes and are typically referred to as flux return legs. Preferably these flux return legs would, along with the yokes, be built up from amorphous steel laminations if space allows. If not, the winding leg and the flux return legs would be built from silicon steel laminations.

From the foregoing description, it is seen that the present invention provides a composite transformer core wherein the low loss characteristics of amorphous steel are exploited to the fullest practical extent. By incorporating amorphous steel only in the core yokes and, if possible, any flux return legs, the requisite increase in ferromagnetic material cross sectional area can be accommodated without an intolerable increase in the core overall physical size. Then by incorporating silicon steel only in the core winding leg or legs which then can be of a smaller cross section, economies in winding conductor costs and power losses are realized. This coupled with the achieved dramatic reduction in transformer core loss more than offsets, from a commercial standpoint, the increased material and manufacturing costs represented by the amorphous steel yokes.

It is thus seen that the objects set forth above, including those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

Having described the invention, what is claimed as new and desired to secure by Letters Patent is:

1. A transformer core comprising, in combination:

A. a pair of legs, at least one of which being a winding leg formed of plural laminations of silicon steel;

B. a pair of yokes each formed of only plural laminations of amorphous steel; and C. joints serially connecting said silicon steel laminations of said winding leg and said amorphous steel laminations of said yokes in a magnetic loop circuit.

2. The transformer core defined in claim 1, wherein said yokes are of larger cross sectional areas than said winding leg.

3. The transformer core defined in claim 2, wherein said joints are stepped-lapped joints providing low reluctance flux paths between said silicon steel laminations of said winding leg and said amorphous steel laminations of said yokes.

4. The transformer core defined in claim 3 wherein said amorphous steel laminations are in the range of 1–2 mils thick and said silicon steel laminations are in the range of 7–11 mils thick, said joints each including a repeating series of mating amorphous steel lamination joint halves and silicon steel lamination joint halves, the number of laminations in each said amorphous steel lamination joint half exceeding the number of laminations in its mating silicon steel lamination joint half.

5. The transformer core defined in claim 3, wherein at least said joint between said winding leg and one of said yokes includes removable ferromagnetic inserts.

6. The transformer core defined in claim 5, wherein said silicon steel winding leg laminations are all of equal length and arranged with the mid-length points thereof incrementally offset lengthwise to create a step pattern of leg joint halves at each winding leg end, and said amorphous steel laminations are arranged in separate groups of laminations with their longitudinal edges laterally offset to create a step pattern of yoke joint halves mateable with said winding leg joint halves.

7. The transformer core defined in claim 2, wherein said silicon steel winding leg laminations are formed having angularly offset terminal end portions, said winding leg laminations being nested together in plural groups with said offset terminal end portions thereof arranged to butt and lap with the terminations of said amorphous steel yoke laminations, whereby to provide said joints.

8. The transformer core defined in claim 2, wherein said joints are in the form of mitered corner joints, said corner joint between said winding leg and at least one of said yokes including removable ferromagnetic inserts.

9. The transformer core defined in claim 2, wherein the ratio of the yoke cross sectional area to the winding leg cross-sectional area is proportional to the relative saturation inductances and packing factors of said silicon steel winding leg laminations and said amorphous steel yoke laminations.

10. The transformer core defined in claim 2, wherein said winding leg is formed exclusively of said silicon steel laminations.

* * * * *